United States Patent [19]

Curry

[11] 4,322,010

[45] Mar. 30, 1982

[54] TAMPER PROOF LID

[76] Inventor: John J. Curry, 2 S 752 Theresa Ct., Oak Brook, Ill. 60521

[21] Appl. No.: 85,975

[22] Filed: Oct. 18, 1979

[51] Int. Cl.[3] ..... B65D 41/48

[52] U.S. Cl. ..... 215/256; 215/321

[58] Field of Search ..... 215/253, 254, 256, 321; 220/270

[56] References Cited

U.S. PATENT DOCUMENTS

| | | | |
|---|---|---|---|
| 2,947,432 | 8/1960 | Marcel | 215/321 |
| 3,247,994 | 4/1966 | Fuglsang-Madsen | 215/321 |
| 3,415,404 | 12/1968 | Robinson | 215/256 |
| 3,622,028 | 11/1971 | Lohrer | 215/253 |
| 3,856,171 | 12/1974 | Rossi | 215/321 X |
| 3,902,621 | 9/1975 | Hidding | 215/254 X |
| 3,985,255 | 10/1976 | Blair | 215/254 |
| 4,043,475 | 8/1977 | Wheeler | 215/256 X |
| 4,066,180 | 1/1978 | Sanchez | 215/254 |
| 4,106,653 | 8/1978 | Martinelli | 215/256 |

*Primary Examiner*—Donald F. Norton
*Attorney, Agent, or Firm*—Charles A. Brown

[57] ABSTRACT

A tamper proof lid which includes an end panel and a depending annular body having means for interlocking with a container neck finish. The annular body has a lower skirt which incorporates a frangible portion. A handle is secured to the frangible skirt portion and a rupturable webbing extends between the handle and the skirt thereby limiting movement of the handle.

10 Claims, 9 Drawing Figures

FIG.5
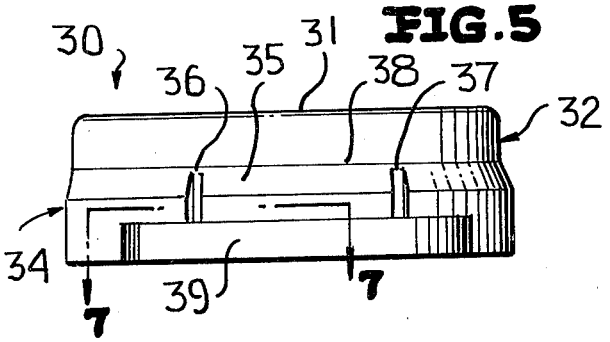
FIG.6
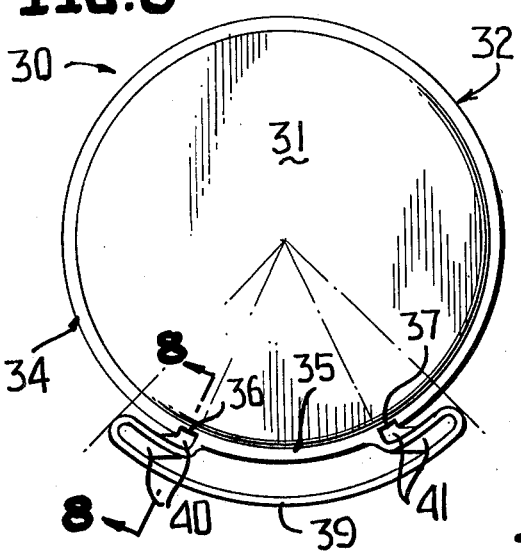
FIG.8
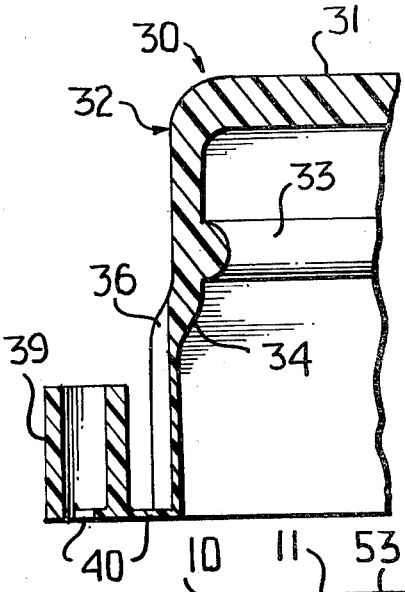
FIG.9
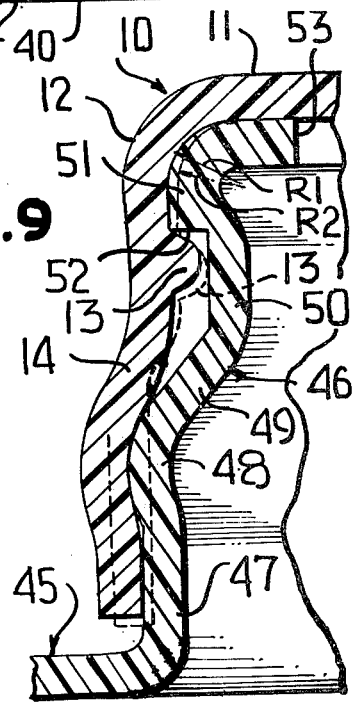
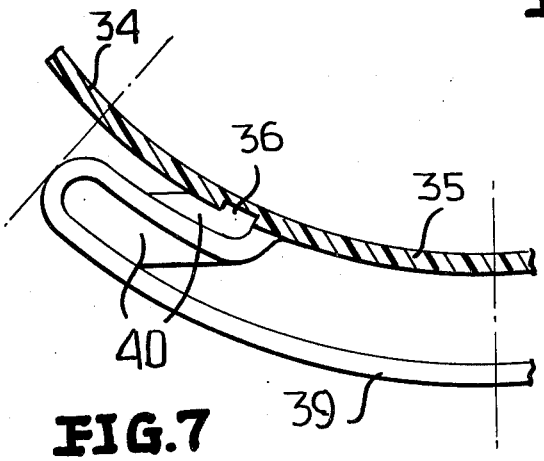
FIG.7

TAMPER PROOF LID

This invention relates in general to new and useful improvements in tamper proof lids or closure caps, and more particularly to lids which tightly fit an associated container but are readily removable therefrom.

Tamper proof lids for containers are well known. Certain of these lids or closure caps have proven to be rather difficult to manipulate in order to open and gain access to the contents of the container. Further, the production of these prior tamper proof lids or closure caps has proven to be rather costly leading to higher expenses in the production of the overall container as well as the cost of goods packaged therein at the retail level.

In accordance with this invention, it is proposed to provide a simple and inexpensive tamper proof lid or closure cap which may be readily actuated to provide access to the contents of an associated container. Also, the lid or closure cap in accordance with this invention provides an inexpensive means of indicating that the container has been tampered with.

Another feature of the invention is the relationship of the lid or closure cap with respect to the container neck finish wherein the closure cap may be easily applied. Further, the relative diameters of the closure cap crown and the neck finish crown bead is made such that when the closure cap is applied to the container neck finish, the closure cap bead is radially outwardly expanded which results in an associated locking bead being drawn axially towards the end panel of the closure cap so as to compressively engage the locking bead with the underside of a locking shoulder on the container neck finish.

A still further feature of the invention is the formation of the lid or closure cap with a generally cylindrical skirt which is of a diameter less than the adjacent portion of the neck finish wherein when the lid is applied to the container neck finish, the skirt of the lid is radially outwardly expanded and has an interference fit with the adjacent neck finish portion.

If desired, the neck finish portion disposed axially coextensive with the lid skirt may be provided with a bottom bead which results in radial outward deformation of the skirt in addition to the aforementioned stretching of the skirt.

Notwithstanding the foregoing features, the tamper proof lid is simple and inexpensive and may be easily removed from an associated container without causing any inconvenience to the individual opening the container.

BRIEF DESCRIPTION OF DRAWINGS

FIG. 5 is a side elevational view of another embodiment of the invention;

FIG. 6 is a top plan view of the embodiment of FIG. 5;

FIG. 7 is an enlarged fragmentary sectional view taken along the line 7—7 of FIG. 5 illustrating generally the details of a handle and its relationship to an axial weakening line in the skirt;

FIG. 8 is an enlarged fragmentary vertical sectional view taken along the line 8—8 of FIG. 6, illustrating the axial cross section of the lid in the area of the axial weakening line; and FIG. 9 is an enlarged fragmentary sectional view showing a typical lid or closure cap formed in accordance with this invention and applied to a preferred neck finish of a container.

Figure 1:
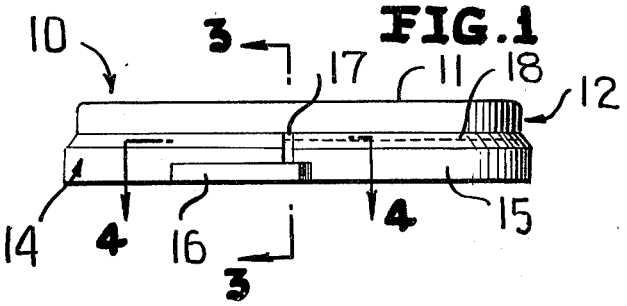
FIG. 1 is a side elevational view of the invention illustrating the tamper indicating feature including a handle secured to a frangible skirt portion of the lid.
Figure 2:
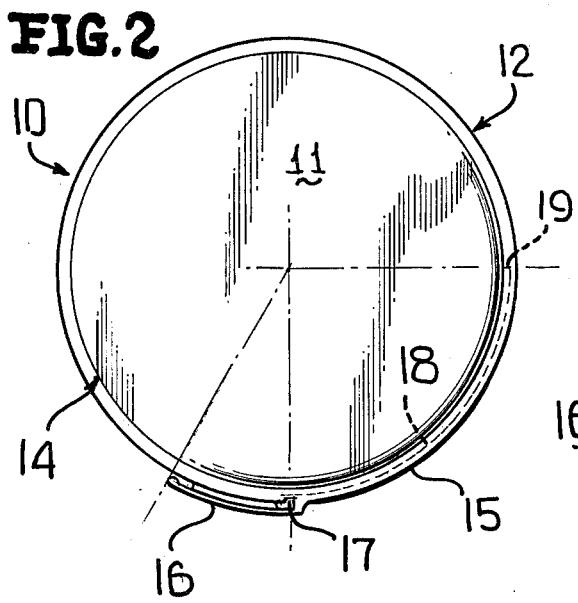
FIG. 2 is a top plan view of the invention as illustrated in FIG. 1, showing further the details of the handle and that portion of the skirt which is fractured to permit removal of the lid from an associated container.
Figure 3:
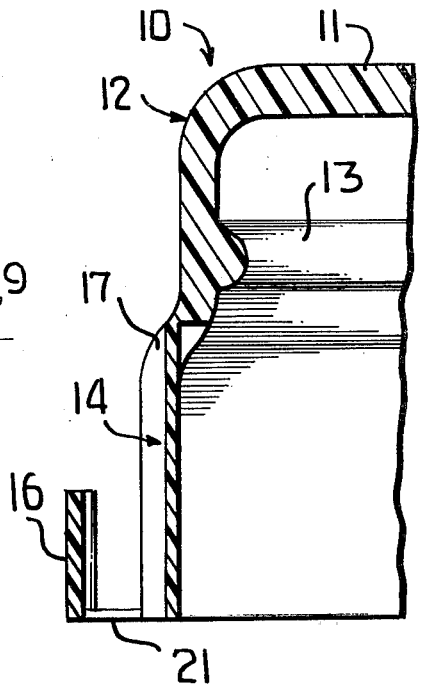
FIG. 3 is an enlarged sectional view taken along the line 3—3 of FIG. 1 illustrating more specifically the details of the handle and its connection to the skirt.
Figure 4:
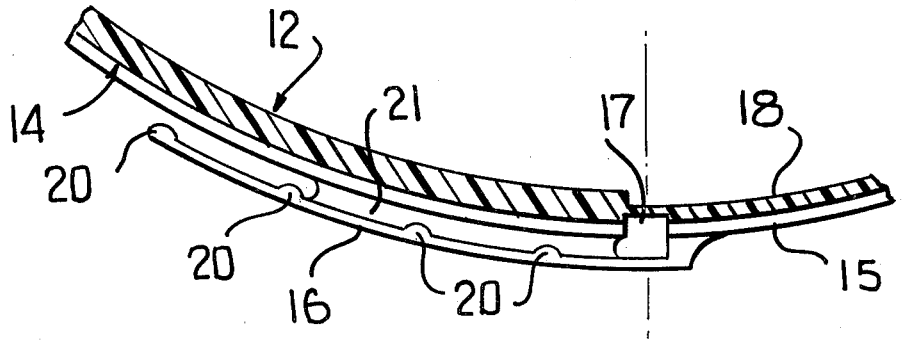
FIG. 4 is an enlarged fragmentary sectional view taken along the line 4—4 of FIG. 1, illustrating the circumferential score weakening line along which the handle is used to facture the skirt portion.

Illustrated in FIG. 1 of the drawings is a preferred embodiment of the tamper proof lid or closure cap, generally designated by the reference numeral 10. The tamper proof lid 10 includes an end panel 11 and a crown portion 12 carrying a locking bead, or if desired spaced lugs 13 for interlocking with an intended neck finish of a container in a manner to be described hereinafter. A lower skirt portion 14, of a larger diameter than the crown 12, depends from the crown below the locking bead 13 and has incorporated therein a frangible portion 15.

A handle or actuating lever 16 is secured to the frangible skirt portion 15. The handle 16 is used as a lever to cause rupture of the frangible skirt portion relative to the remainder of the skirt. Rupture of the frangible skirt portion will be described in greater detail hereinafter.

The frangible skirt portion 15 is defined by an axial score or weakening line 17 which intersects with one end of a circumferential score or weakening line 18. The opposite end of the circumferential score or weakening line 18 terminates at an axial hinge line 19.

Initial movement of the handle 16 causes the frangible skirt portion 15 to be separated from the remainder of the skirt 14 by first rupture of the skirt along the axial score or weakening line 17 followed by rupture of the skirt along the circumferential score or weakening line 18 as the handle 16 is moved through generally a 90° arc. Finally, the handle 16 is used as a lever to effect the frangible skirt portion 15 to hingeably swing along the axial hinge line 19 and allow the user to pull the tamper proof lid 10 from an associated container. It is to be noted that the handle 16 is provided with vertical ribs 20 at spaced intervals to facilitate gripping of the handle.

In accordance with the invention, there is a frangible or rupturable webbing 21 which extends between the handle 16 and the lower part of the skirt 14. The frangible or rupturable webbing 21 will be caused to be separated from the handle 16 in the lower portion of the skirt 14 when a user exerts a lever-like action on the handle 16. Thus, it would be readily apparent that the frangible or rupturable webbing 21 will display a severed condition so as to clearly indicate that the tamper proof lid 10 has been tampered with.

Another embodiment of the present invention is illustrated in FIGS. 5–8 and is generally designated by the reference numeral 30. The lid or closure cap 30 includes an end panel 31 and an annular crown 32 having an internal lug arrangement or locking bead 33 for interlocking with a container neck finish in the same manner as the embodiment of FIGS. 1–4. The lid 30 also includes a skirt 34 which depends below the crown 32 and is of a larger diameter than the crown. The skirt 34 incorporates a frangible or radially deflectible portion 35.

The skirt portion 35 is defined by a pair of circumferentially spaced axial score or weakening lines 36 and 37 each of which intersects with a circumferential hinge line 38.

A generally U-shaped handle or actuating lever 39 is secured to the skirt portion 35 in areas closely adjacent to the respective axial score or weakening lines 36 and 37. The handle 39 is used as a lever to effect the rupture or fracture of the skirt along the score weakening lines 36 and 37.

Exertion of a radially outwardly force pulling the handle 39 from the skirt 34 initially causes rupture of the respective axial score or weakening lines 36 and 37 and then a further radially outwardly directed pulling force on the handle 39 results in a hinging of the skirt portion 35 relative to the remainder of the skirt along the circumferential hinge line 38. This increases the diameter of the skirt 34 and permits removal of the lid 30 from an associated container.

It is to be noted that the handle 39 is initially retained in a folded position closely adjacent the skirt by two straps of frangible or rupturable webbing 40, 41. Each of the frangible webbing 40, 41 is also secured to a lower part of the skirt 34 in an area adjacent the respective axial score or weakening line 36 or 37 and extends therefrom to the handle 39, as well as between portions of the handle 39 as is clearly shown in FIGS. 7 and 8.

It can be clearly seen that the manipulation of the handle 39 in a radially outwardly direction from the skirt 34 will cause rupture of the frangible webbings 40 and 41 both between the handle 39 and the skirt 34 and between the folded portions of the handle 39 permitting the handle 39 to protrude radially outwardly to indicate that the container has been tampered with. Further, the outward protrusion of the handle 39 facilitates the gripping thereof necessary to effect rupture of the skirt along the score or weakening lines 36 and 37.

Reference is now made to FIG. 9 wherein a typical lid or closure cap, for example the lid 10 is illustrated applied to a neck finish of a container, the container being generally identified by the numeral 45. The neck finish is generally identified by the numeral 46 and includes a cylindrical base portion 47 which is provided at the upper end thereof with a lower bead 48 and then has a tapered generally frustro conical portion 49. The portion 49 terminates in another cylindrical portion 50 which is of a smaller diameter than the base portion 47. The upper part of the neck finish 46 is in the form of a crown bead 51 which defines at the underside thereof a locking shoulder 52 and at the upper end thereof in an end wall 53.

The original shape of the lid or cap 10 is illustrated in FIG. 9 in dotted lines and in solid lines in its expanded, as applied configuration. First of all, it is to be noted that the crown bead 51 has an outer surface of a radius $R_1$ which is greater than a radius $R_2$ of the inner surface of the crown 21 when the lid or closure cap 10 is initially formed. Secondly, while the skirt 14 does flare radially outwardly slightly, it initially is primarily cylindrical.

It will be readily apparent that the skirt 14 readily slips over the crown bead 51 with the lower end of the skirt resting loosely on the lower bead 48. Then a downward force simultaneously pushes the locking bead 13 under the crown bead 51 and below the locking shoulder 52 distorting the whole crown area 12 and at the same time pushing the skirt 14 over the bottom bead 48 completely distorting the skirt 14.

Inasmuch as the crown bead radius is greater than the radius of the internal surface of the crown 12, it will be seen that the crown 12 is radially outwardly deformed and is tensioned, thereby drawing the bead 13 radially upwardly so as to compressively engage the shoulder 52. In this manner the lid or closure cap 10 is assured a tight seal with the lid finish 46. At the same time, due to the outward expansion of the skirt 14, there is an interference fit between the skirt and the neck finish tightly holding the bottom part of the skirt onto the neck finish and forming a secondary seal against the entrance of foreign matter between the closure cap and the neck finish.

The closure cap or lid 10 as set forth in FIGS. 1–4 is so structured in order to accommodate wide mouth containers of approximately 100 millimeters size. On the other hand, the lid or closure cap 30 as shown in FIGS. 5–8 is structured to accommodate containers of narrow mouth sizes on the order of 38 millimeters.

The conventional type screw caps and snap-on caps which are currently employed to seal wide mouth packages, preferably plastic one gallon volumes and even containers of the five gallon volume, are subject to certain problems which the current lid or closure cap 10 overcomes. The basic problem is the fact that the conventional caps are rigid while the container itself is flexible. The result is that during standard reuse test one will find that the cap will displace and/or rupture around the contents of the container to leak out, or due to the rigidity of the conventional caps, they will pop off from the neck finish of the plastic container.

The new caps overcome these difficulties by instead of popping off during a drop test or cracking when failing to properly distort with the neck finish of the plastic container, tends to stay on and distort with the deflecting neck finish of an associated plastic container due to the interference fit between the neck finish and the cap and the flexibility of the cap.

Notwithstanding these advantageous features, the lids or closure caps of this invention are readily removable by rupturing the skirt and permitting the skirt to expand, thereby relieving the interference fit. On the other hand, the fracturing of the skirt is such that no portion of the lid or cap has to be completely removed and thus all portions of the cap remain integral with one another.

It should be understood that the present invention is not necessarily limited to these two particular size containers. Further, it should be understood that the present invention may be made in a number of different ways without substantially departing from the novelty of the invention as set forth in the description above and the appended claims hereinbelow.

I claim:

1. A tamper proof lid, said lid comprising a crown and a depending annular body having means for interlocking with a container neck finish, said annular body having a lower skirt incorporating a frangible portion, a handle secured to said frangible skirt portion and extending in a generally circumferential direction coextensive with a radially adjacent portion of said skirt, and rupturable webbing extending between said handle and said skirt for normally holding said handle to said skirt, said frangible skirt portion being defined in said skirt by two spaced generally parallel axial score weakening lines each intersecting with opposing ends of a generally circumferential hinge line.

2. A lid as set forth in claim 1 wherein said handle is a strap-like strip secured adjacent to said generally parallel axial score weakening lines and is movable to initially rupture each of said axial score weakening lines and hingeably swing from said circumferential hinge line whereby said lid is caused to be removed from an associated container.

3. A tamper proof lid, said lid comprising a crown and a depending annular body having means for interlocking with a container neck finish, a container neck finish of the type including a crown bead terminating in an end wall, said neck finish being of a reduced diameter below said crown bead to define a downwardly facing shoulder, said means for interlocking with a container neck finish is in the form of a radially inwardly directed rib disposed adjacent said crown and spaced below an end panel of said crown a preselected distance, and said crown having a lesser internal diameter than said crown bead; and said lid being applied to said container neck finish with said end panel being seated on said end wall, said crown being radially outwardly expanded, and said rib being drawn axially towards said end panel and in axially compressed engagement with said shoulder.

4. A tamper proof lid, said lid comprising a crown and a depending annular body having means for interlocking with a container neck finish, said annular body having a lower skirt, a container neck finish of the type including a crown bead terminating in an end wall, said neck finish being of a reduced diameter below said crown bead to define a downwardly facing shoulder, said means for interlocking with a container neck finish is in the form of a radially inwardly directed rib disposed adjacent said crown and spaced below an end panel of said crown a preselected distance, said rib being engaged beneath said shoulder, said skirt being cylindrical below said rib, and said neck finish axially coextensive with said skirt being of a larger diameter than the internal diameter of said skirt, and said skirt having a stretched interference fit with said axially coextensive neck finish portion.

5. A lid as set forth in claim 4 wherein said axially coextensive neck finish portion includes a radially outwardly directed rib, and said skirt is radially outwardly deformed to match said radially outwardly directed rib.

6. A tamper proof lid, said lid comprising a crown and a depending annular body having means for interlocking with a container neck finish, said annular body having a lower skirt incorporating a frangible portion, a handle secured to said frangible skirt portion and having a major part of its length extending in a generally circumferential direction coextensive with a radially adjacent portion of said skirt, said frangible skirt portion being in part defined by a circumferential score weakening line and said circumferential score weakening line is defined by said frangible skirt portion being radially outwardly offset beyond an axially adjacent portion of said body.

7. A tamper proof lid, said lid comprising a crown and a depending annular body having means for interlocking with a container neck finish, said annular body having a lower skirt incorporating a frangible portion, a handle secured to said frangible skirt portion and having a major part of its length extending in a generally circumferential direction coextensive with a radially adjacent portion of said skirt, and rupturable webbing extending between said handle and said skirt for normally holding said handle to said skirt, said rupturable web being permanently part of said skirt and said handle is peelable from said frangible web.

8. A tamper proof lid, said lid comprising a crown and a depending annular body, said body including upper and lower portions, said body upper portion having a radially inwardly directed rib for interlocking with a container neck finish, said lower body portion being in the form of a lower skirt for preventing prying of said lid from a container, said skirt having an axial score line extending the full height of said skirt for initiating rupture of said skirt, and there being a partial circumferential weakening line disposed generally parallel to a free edge of said skirt between said skirt and said upper body portion, said circumferential weakening line being of such limited circumferential extent to define a frangible skirt portion of limited circumferential extent sufficient to release said lid from an associated container, said frangible skirt portion being permanently connected along an axial hinge line to the remainder of said skirt at the end of said frangible skirt portion disposed remote from said axial score line, and a handle carried by said frangible skirt portion for effecting rupture of said body along said axial score line and said circumferential weakening line.

9. A lid as set forth in claim 8 wherein said circumferential weakening line is defined by said frangible skirt portion being radially outwardly beyond an axially adjacent portion of said body.

10. A tamper proof lid, said lid comprising a crown and a depending annular body having means for interlocking with a container neck finish, said annular body having a lower skirt incorporating a frangible portion, a handle secured to said frangible skirt portion and extending in a generally circumferential direction coextensive with a radially adjacent portion of said skirt, and rupturable webbing extending between said handle and said skirt for normally holding said handle to said skirt, said handle being a strap-like strip secured to said frangible skirt portion at two circumferentially spaced points, said frangible skirt portion being in part defined by an axial score, and one of said points being adjacent said axial score, said handle strip being reversely folded adjacent said one point of securement.

* * * * *